United States Patent [19]

Gudmestad et al.

[11] Patent Number: 5,076,732

[45] Date of Patent: Dec. 31, 1991

[54] METHOD FOR THE CONSTRUCTION OF CONCRETE SHAFTS FOR A PLATFORM OR SIMILAR STRUCTURE AND A SECTION FOR SIMILAR USE

[75] Inventors: Ove T. Gudmestad, Naerbo; John W. A. Coker, Royneberg; Brian L. Stead; Terje A. Warland, both of Sandnes, all of Norway

[73] Assignee: Den Norske Stats Oljeselskap A.S., Stavanger, Norway

[21] Appl. No.: 466,407

[22] PCT Filed: Sep. 2, 1988

[86] PCT No.: PCT/NO88/00066

§ 371 Date: Mar. 5, 1990

§ 102(e) Date: Mar. 5, 1990

[87] PCT Pub. No.: WO89/02007

PCT Pub. Date: Mar. 9, 1989

[30] Foreign Application Priority Data

Sep. 3, 1987 [NO] Norway ..... 873684

[51] Int. Cl.[5] ..... E02D 25/00

[52] U.S. Cl. ..... 405/204; 405/222; 405/252; 264/32; 264/34; 264/35; 264/256; 264/262; 264/274

[58] Field of Search ..... 405/197, 204, 222, 252; 264/31-35, 256, 262, 274; 249/10, 11, 17; 425/63

[56] References Cited

U.S. PATENT DOCUMENTS

| | | | |
|---|---|---|---|
| 2,065,003 | 12/1936 | Widuger | 405/222 X |
| 3,545,214 | 12/1970 | Grazel | 405/252 |
| 3,625,012 | 12/1971 | Thorburn | 405/252 |
| 3,651,653 | 3/1972 | Mouton, Jr. | 405/252 |
| 4,605,340 | 8/1986 | Stephan | 405/252 |
| 4,643,617 | 2/1987 | Kanno et al. | 405/222 |
| 4,836,717 | 6/1989 | Landaeus et al. | 405/252 |

FOREIGN PATENT DOCUMENTS

| | | | |
|---|---|---|---|
| 965226 | 4/1975 | Canada | 425/63 |
| 0096650 | 12/1983 | European Pat. Off. . | |
| 1234974 | 6/1971 | United Kingdom . | |
| WO84/01592 | 4/1984 | World Int. Prop. O. . | |

*Primary Examiner*—Dennis L. Taylor
*Assistant Examiner*—J. Russell McBee
*Attorney, Agent, or Firm*—Foley & Lardner

[57] ABSTRACT

Procedure for the construction of a concrete shaft for a platform or similar structure, where one of several of the shafts will be outfitted with relatively much equipment. The shafts are constructed of prefabricated sections which are consecutively installed butt-in-butt on top of each other and which are left in the shaft as an internal fully shaped shaft component, as the sections internally contain associated equipment and externally feature bodies for the installation of easily removable formwork elements, preferably easily mountable slipforms, while the space between the formwork elements and a prefabricated section is filled with reinforcement and concrete. The formwork elements, after the hardening of poured concrete, by a per se known procedure, are moved to a higher level.

10 Claims, 6 Drawing Sheets

METHOD FOR THE CONSTRUCTION OF CONCRETE SHAFTS FOR A PLATFORM OR SIMILAR STRUCTURE AND A SECTION FOR SIMILAR USE

The present invention relates to a method for the construction of concrete shafts for a platform or similar structure which may for instance rest on the seabed, where one or several shafts will be outfitted with relatively much equipment.

The present invention in addition relates to a section to be used as an internal formwork and/or stiffening for the construction of a concrete shaft in a platform or similar structure which may for instance rest on the seabed.

So far, it has been common to use traditional slipforming for the construction of a platform or similar structure. This means that the shaft must first be constructed in its full height, and any outfitting in the shaft must be subsequently performed. Thus, considerable work and time will be spent on the outfitting of the shafts with said equipment after the completed casting of the shafts. This gives substantial additional construction cost.

By outfitting the individual concrete shaft of the said type with the necessary equipment simultaneously with the casting of the shafts, the present invention is intended to reduce the required construction time and thus also the costs. In other words, the intention, at least for the shafts to be outfitted with equipment, is to construct the shafts in a new way, while other shafts, if any, are constructed by means of traditional slipforming. It should be observed that the advantages of the invention increase with the depth of the water.

The new construction method according to the invention is characterized by the shafts of the said type being constructed of prefabricated sections which are consecutively installed butt-in-butt on top of each other and which are left in the shaft as an internally fully shaped shaft component, as the sections internally contain the associated equipment and externally feature bodies for mounting of easily removable formwork elements or attachments for slip-forming. The sections either serve as internal formwork where the external formwork is subsequently installed, or alternatively, as an attachment for internal formwork as they are built up by means of tubulars on which the internal and external formworks are attached. The space between the formworks is filled with reinforcement and concrete, by a per se known procedure, and is thus moved up to a higher level.

According to the invention, the advantage of this is that said sections may be built in heights of 15–20 m, which may in their turn be put together to form longer sections onshore prior to being transferred to the platform. The sections which form the internal formwork or attachment for the internal formwork may be prefabricated on an appropriate construction site with associated equipment completely installed in sections, in an easily accessible way on an appropriate installation site - and said sections may later be consecutively installed in the shaft, which is under construction, in a relatively simple and accurate way. The easily accessible section provides a correspondingly effective installation of the equipment in each individual section. In addition, a particularly rational installation of the equipment in the different sections is provided, as the sections can be constructed and outfitted with equipment independently of the construction of the actual shaft.

As soon as one section has been installed in the shaft, which is under construction, this part of the shaft has simultaneously been prefabricated internally, and the different sections can subsequently be consecutively attached on top of each other and the shaft can be prefabricated internally, as the shaft is gradually constructed. Consequently, when the casting of the shaft is completed, the shaft will simultaneously be fully outfitted internally. Thus, the total time spent on the platform construction or similar structure can to a considerable extent be reduced by a corresponding reduction of the otherwise normal time spent on the outfitting of shafts.

A section according to the invention is characterized by comprising a cylindrically shaped section with a diameter for instance of 10 to 40 m of steel sheet, or alternatively being built up of tubular elements, which internally feature one or several horizontal dividers for support of the equipment to be installed in the shaft and which externally feature stiffening bodies, at least some of these being adjusted to form an attachment for easily mountable and easily dismountable formwork elements, by said dividers and said stiffening bodies being adjusted to stiffen the section during the transportation of the same from the construction site to the place of installation and being part of the constructed concrete shaft.

In addition to the reduction of time required for the construction of the platform or similar structure, installation-related advantages are obtained, as already mentioned, as there is a better accessibility to the section and different individual sections respectively than to an extended shaft. In connection with the previously employed slipforming, it was necessary to construct special horizontal dividers at various levels directly in the actual shaft followed by the installation of the equipment on the different horizontal dividers. By the present invention, where said dividers are built directly into the associated segment and where the segments can be assembled and joined together butt-in-butt to form a continuous structure internally in the shaft, there will be labour-related (assembly-related) and construction-related advantages. By installing the equipment in a section, the assembly work can be limited to said butt-in-butt assembly and joining together of the sections in relation to one another during the construction of the sections in the shaft. Moreover, by means of the horizontal divider or the horizontal dividers in each section, an effective extra stiffening is obtained for the section during the transportation of the same from the construction site to the installation site, i.e. during the transportation directly to the assembly in the shaft which is under construction.

Further characteristics of the invention will appear from the subsequent description with reference to the enclosed drawings, which show the preferred embodiments, of which:

FIGS. 1-4 generally show the mounting of the formwork for a shaft where a platform or other concrete structure may for instance rest on the seabed.

Figure 5:
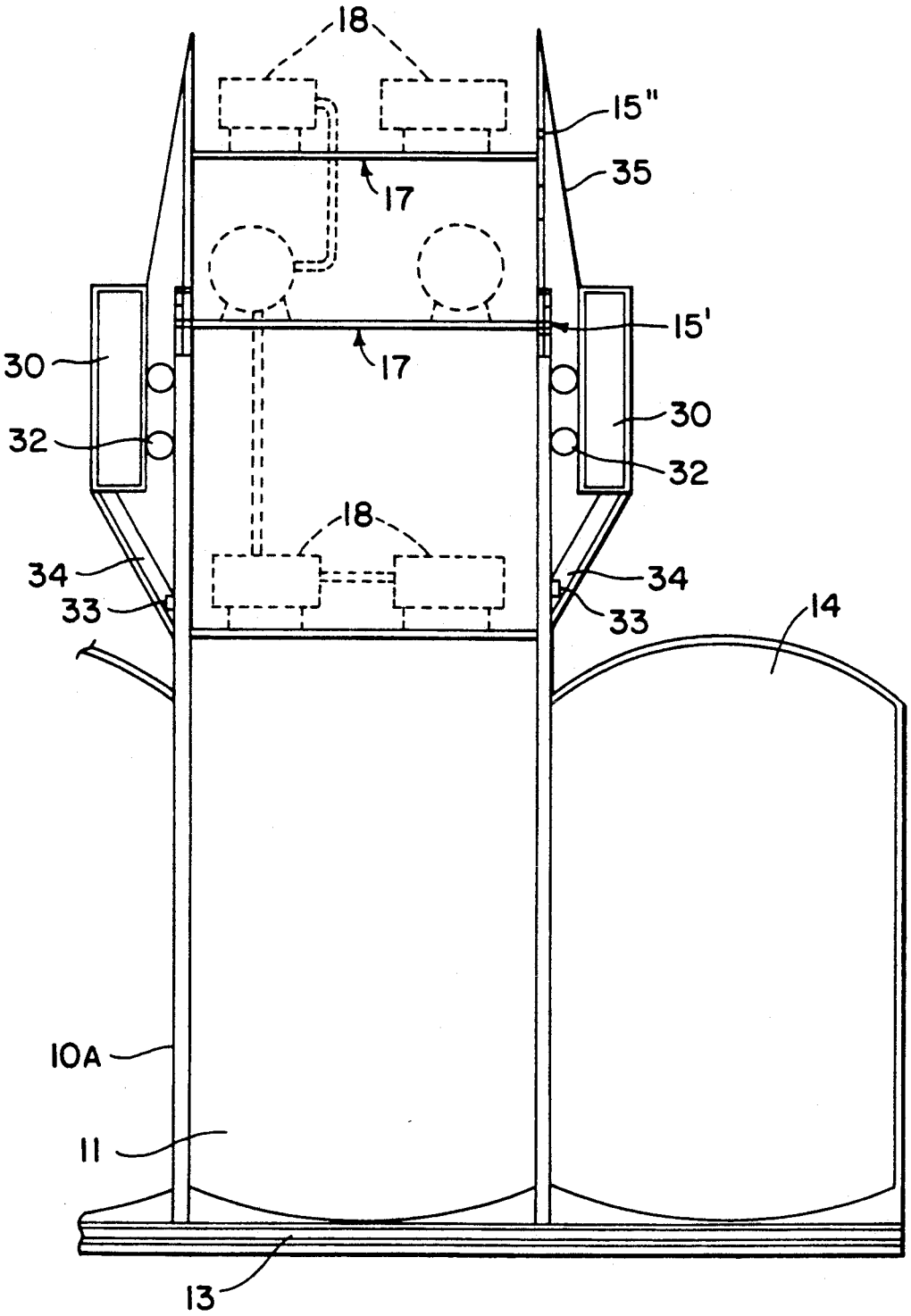
FIG. 5 is a vertical sectional view of the lower foundation with associated storage cells and the lower part of a shaft according to the invention, shown during the casting.

FIG. 5 shows the actual construction of the shaft 10 in connection with a foundation 11 which may for instance rest on the seabed through a lower base-plate (13). The shaft 10 rests directly on the base-plate through a tubular lower shaft section 10*a*, said shaft may be constructed by a per se known procedure in a rigid connection with cells (14) spaced around the circumference, said cells being adjusted to form tanks for ballast and/or for storage of oil or condensate produced from the seabed. After the cells 14 and the lower shaft part 10*a* have been prefabricated by a per se known procedure in a continuous piece with the base-plate 13, the further construction of the shaft continues by a new procedure according to the invention, as described below. Alternatively, the lower shaft part (10*a*) or parts of the same may be constructed in the same way as the rest of the shaft (10), this is particularly relevant if the lower shaft part contains much equipment.

A separate section 15 is subsequently constructed, corresponding to that shown in FIGS. 1 and 2, on an appropriate construction site separated from the construction site of the actual shaft. The section 15 generally consists of a cylindrical steel sheet 16 (e.g. with a thickness of 25 mm) and a number of horizontal dividers 17. On the different dividers 17, the relevant equipment is pre-installed as indicated by broken lines 18, and a flight of stairs 19 is indicated between the dividers 17. In addition, hatches may be installed (not further shown) for coverage of the upper end of the flight of stairs and hatches (not further shown) for vertical transportation of equipment between the different stories. In the illustrated embodiment, a section is shown which may comprise a randomly chosen number of story heights, but evidently, when desirable, each section may have only a few or even one single story height.

Figure 1:
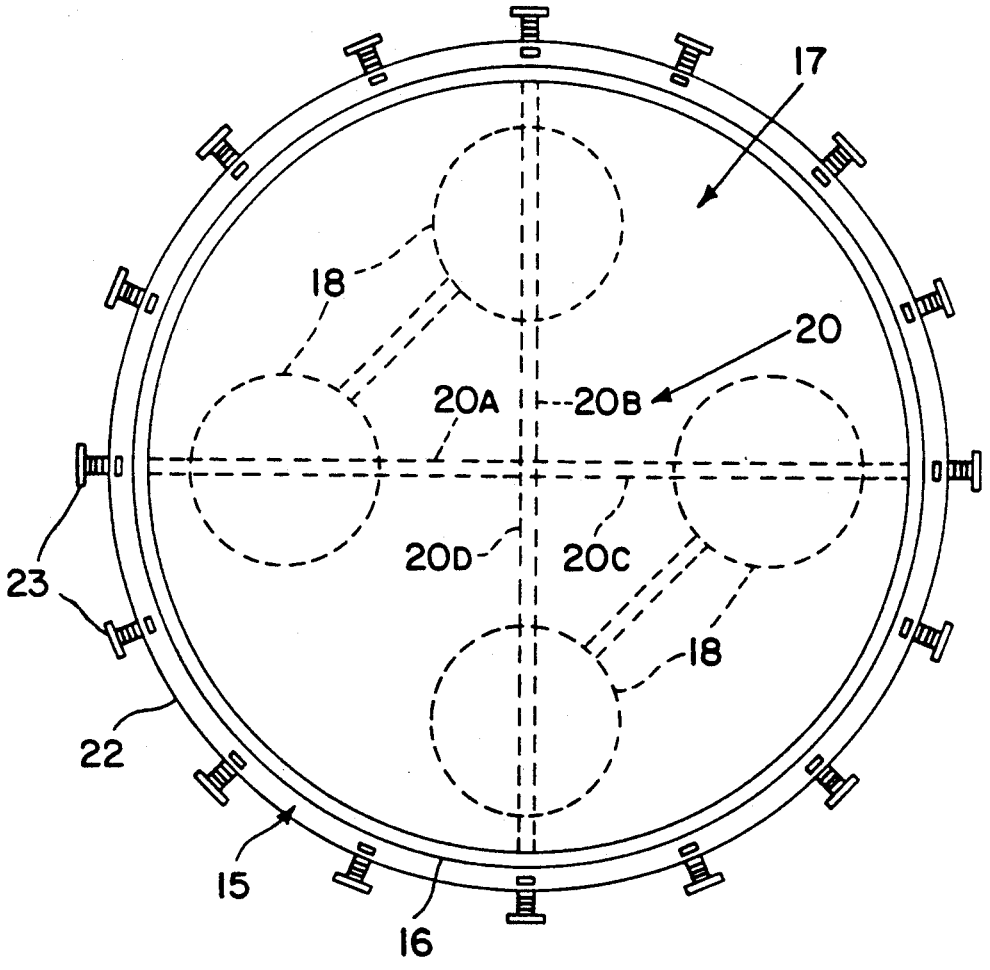
FIG. 1 is a horizontal sectional view of a section according to the invention for use during the construction of a concrete shaft in a platform which may for instance rest on the seabed.
Figure 2:
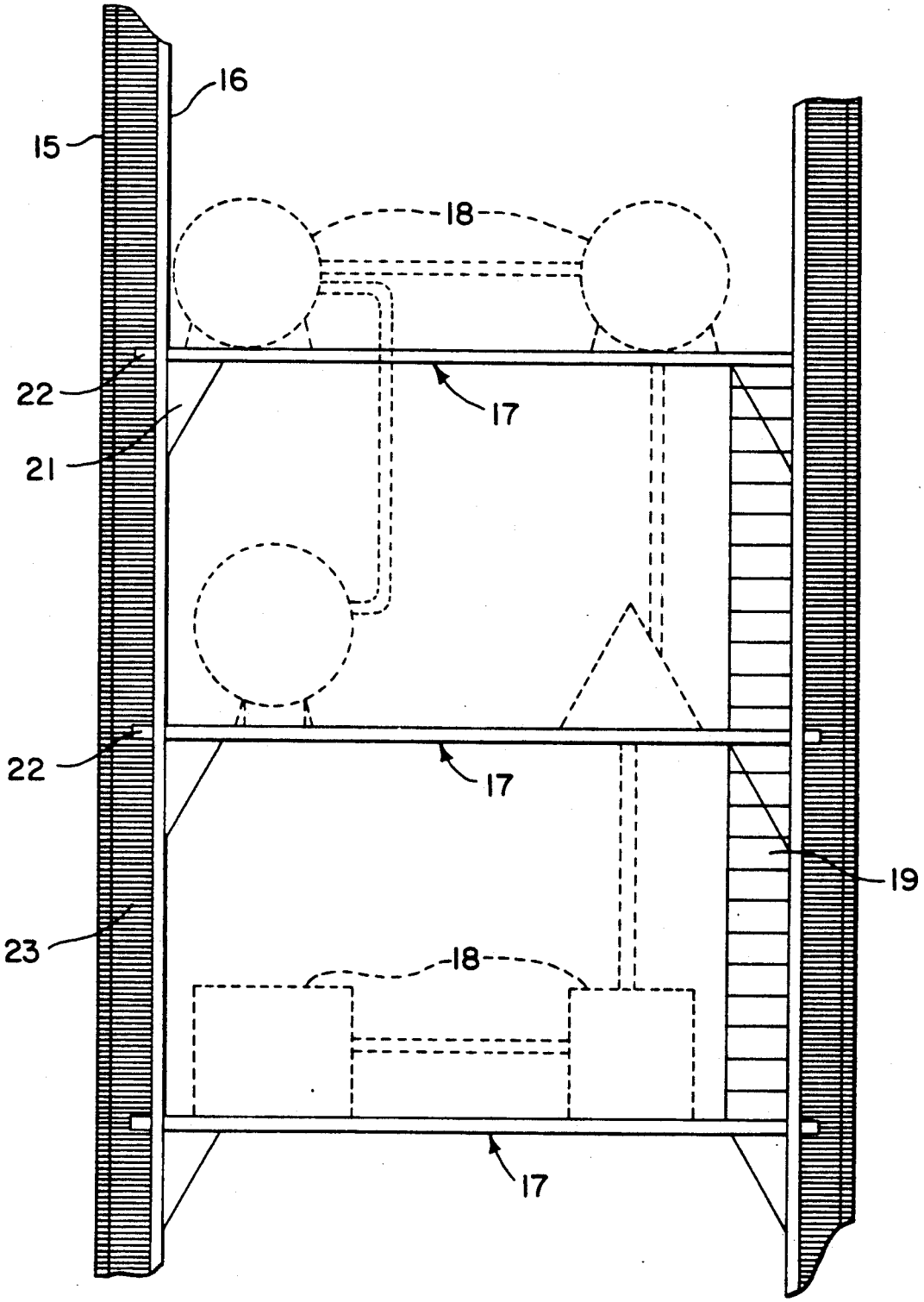
FIG. 2 is a vertical sectional view of a section according to FIG. 1.

In the embodiment shown in FIG. 1 (and FIG. 3), a schematic location is shown of four equipment components on one horizontal divider 17, each component being located right above an associated beam section 20*a*, 20*b*, 20*c*, 20*d* in a cruciform beam structure 20, which forms a stiffening for each story divider In FIG. 2, it is indicated that the beam structure 20 is supported by angle pieces 21 for stiffening of the beam structure 20 internally of the tube 16.

Externally, the section 15 features an annular horizontal stiffening body 22 (only shown in FIGS. 1-3) at the section's upper free end. Alternatively, several such horizontal mutually parallel stiffening bodies may be installed at various levels in the vertical direction on the tube. Moreover, vertical stiffening bodies 23 have been welded externally of the tube which have a T- shaped cross-section with a typical T-shape dimension of 0.1 m in the full vertical direction of the section. The different sections may for instance be joined together butt-in-butt by means of a continuous annular weld and may in addition be mutually connected through welds by mutually aligned vertical stiffening bodies 23.

Figure 3:
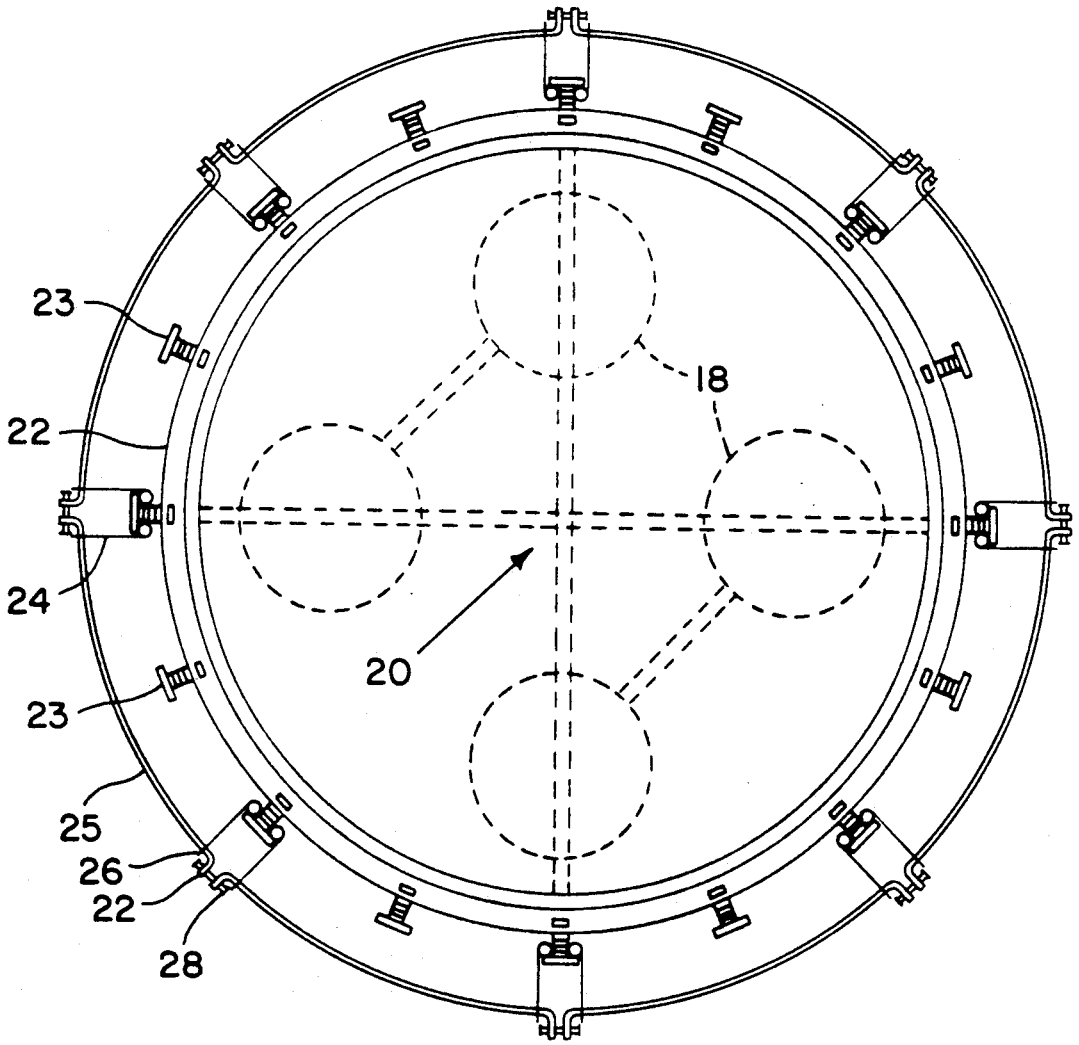
FIG. 3 is a horizontal sectional view corresponding to FIG. 1, the section featuring external formwork elements.
Figure 4:
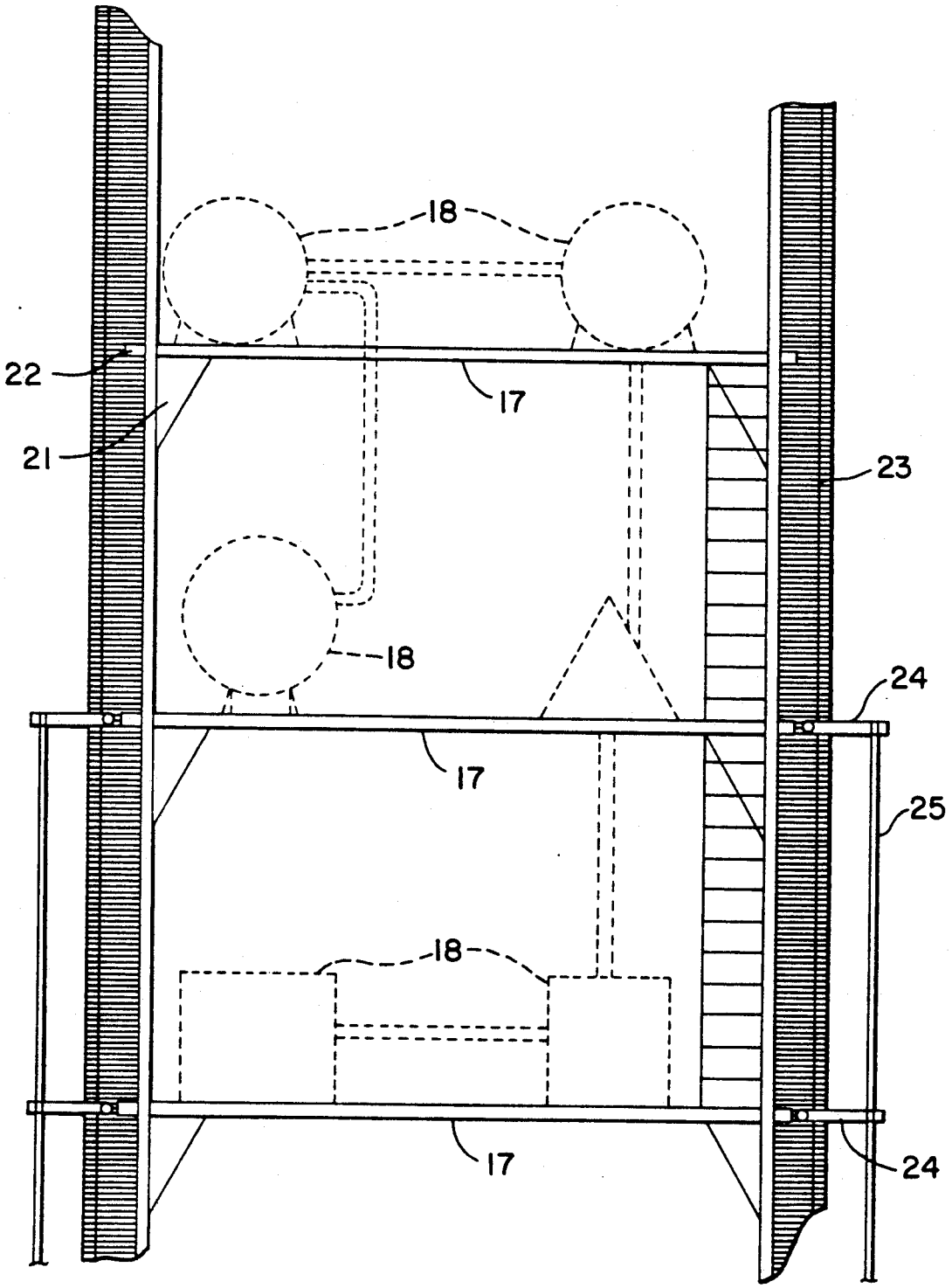
FIG. 4 is a vertical sectional view corresponding to the section in FIG. 2 featuring external formwork elements, shown during ;the construction of the external formwork.

By designing the vertical stiffening bodies in a T-shape according to the invention, with the T-shape's cross piece turned radially outward, appropriate anchoring bodies 24 may be effectively anchored to the internal formwork formed by the sections 15, for clamping of external formwork elements 25 to the internal formwork, as shown in FIGS. 3 and 4. Bow-shaped anchoring bodies 24 are shown, which are threaded into place on the stiffening bodies 23 and are somewhat radially extended outside the same for support of the formwork elements 25 at a suitable distance radially outside the internal formwork. The bow-shaped anchoring bodies 24 may for instance, as illustrated, feature outwardly extended support surfaces endwise, as mounting bolts 26 may be introduced through corresponding holes in the formwork elements for attachment in threaded fastening holes in said support surfaces The formwork elements 25 may moreover be connected sideways in pairs by means of mounting bolts 27 with associated retaining screws 28 introduced through fastening holes in radially outwardly facing flanges on the formwork elements 25.

According to the embodiment shown in FIG. 3, sixteen stiffening bodies 23 are shown, but only eight of these are used for attachment of the formwork elements.

According to FIG. 5, an embodiment is shown where the casting of a first section 15' in the shaft is practically completed, while a second section 15'' is installed over the section 15', ready for the mounting of external formwork elements. On the fully cast part of the shaft, i.e. in the illustrated embodiment on the part which contains section 15', an annular work platform 30 is attached which may rest against the shaft through pairs of rollers 32 on diametrically oppositely facing sides of the shaft. The work platform 30 may be attached to the shaft through brake bodies 33 at the inner end of skewed downwardly and inwardly turned support arms 34. In addition, the work platform may be supported through support wires 35 attached to the top of the upper section—in the illustrated embodiment, the top of section 15''. From the work platform, the joining together may be done butt-in-butt with the abutting sections and parts connected to these, including the installation of the external formwork elements, as the shaft is being constructed in the vertical direction As the shaft is gradually cast and hardened, the formwork elements are moved, e.g. by the completely hardened shaft parts being slid upward for installation on a section above, and when this is completely or more or less completely cast, the formwork is moved further upward, and the process is subsequently continued in a corresponding way to the top of the shaft. When the shaft has been constructed in full height, the associated equipment in the shaft has been correspondingly installed at the respective levels along the shaft.

Figure 6:
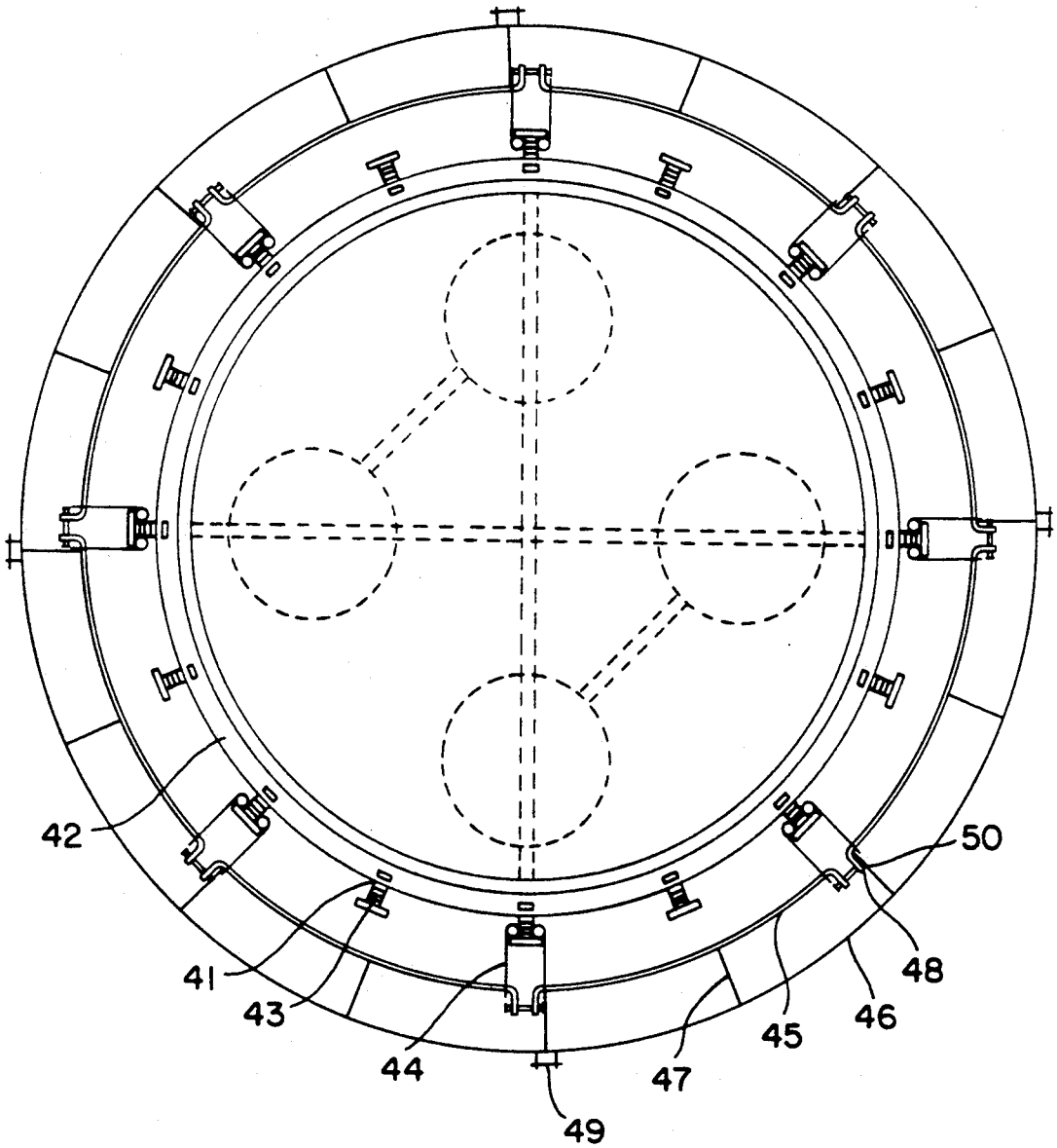
FIG. 6 is an alternative embodiment by the section being built up of a tubular element on which internal and external formworks have been installed.

FIG. 6 shows an alternative way of installing formwork elements on the sections which contain equipment 18. The sections are built up of horizontal 41 and vertical 42 tubes respectively On the vertical tubes, T-shaped stiffening bodies 43 are installed with the T-shape's cross piece turned radially outward, on which appropriate anchoring bodies 44 may be effectively anchored for the internal formwork 45. The external formwork 46 may be attached to the internal formwork with stiffeners 47 and the formworks may be screwed together with mounting bolts 48, 49 with associated retaining nuts 50 introduced through the fastening holes in the radially outwardly turned flanges on the formwork elements 45 and 46.

We claim:

1. The method of constructing a concrete shaft or similar structure for receiving equipment, comprising:

a) consecutively installing a plurality of prefabricated shaft component sections inn an end-to-end relationship, the sections including a plurality of external stiffening bodies;

b) attaching formwork elements to the external stiffening bodies at a first level;

c) filling a space between the formwork elements and the sections with concrete; and d) moving the formwork to a second level.

2. The method according to claim 1, further comprising a supporting equipment internally on the sections.

3. The method according too claim 1, further comprising:

a) casting a shaft section in a foundation with a plurality of associated cells encasing the shaft, the shaft being located in a platform for storage of oil, the platform being installed with equipment; and b) installing the sections consecutively in the shaft section.

4. The method according to claim 3, including resting the platform on a seabed.

5. A prefabricated shaft component section for use in the construction of a concrete shaft in a platform, comprising:

a) a cylindrical steel sheet having a plurality of horizontal dividers for supporting equipment; and b) a means for stiffening the sections during transportation and construction including a plurality of stiffening bodies, at least some of the bodies including adjustable means for attaching a plurality of formwork elements thereto.

6. A prefabricated section according to claim 5, wherein at least some of the stiffening bodies comprise vertical bodies, the bodies extending vertically outwardly from the section and being T-shaped with an external cross-piece of the T forming a plurality of attachment bodies.

7. A prefabricated section according to claim 6, wherein the attachment bodies are radially outwardly extending clamping rings for the attachment of a plurality of external formwork elements by means of mounting bolts or the like.

8. A prefabricated shaft component section according to claim 5, wherein the platform rests on a seabed.

9. A prefabricated shaft component section for use in the construction of a concrete shaft in a platform comprising:

a) a plurality of steel tubes, the tubes being welded together horizontally and being welded vertically to a tubular lattice framework;

b) at least one horizontal divider located inside the tubes for supporting equipment; and c) a means for stiffening the sections during transportation and construction, including a plurality of external stiffening bodies, at least some of the bodies including adjustable means for attaching a plurality of formwork elements thereto.

10. A prefabricated shaft component section according to claim 9, wherein the platform rests on a seabed.

* * * * *